US006027438A

United States Patent [19]

Frazier et al.

[11] Patent Number: 6,027,438

[45] Date of Patent: Feb. 22, 2000

[54] METHOD AND APPARATUS FOR MANUFACTURING A FLUID POUCH

[75] Inventors: Steven G. Frazier, Stockbridge; Hsar Hmun, Norcross, both of Ga.; Steven Gosling, Brampton; Michael Coo, Burlington, both of Canada

[73] Assignee: The Coca-Cola Company, Atlanta, Ga.

[21] Appl. No.: 09/041,609

[22] Filed: Mar. 13, 1998

[51] Int. Cl.[7] ..... B31B 1/64

[52] U.S. Cl. ..... 493/196; 493/200; 493/209; 493/217; 493/267; 493/346; 493/381

[58] Field of Search ..... 493/186, 189, 493/193–196, 198, 200, 203, 204, 209, 210, 212, 213, 217, 223, 267, 379, 381, 390, 391, 393, 346; 53/412

[56] References Cited

U.S. PATENT DOCUMENTS

| | | | |
|---|---|---|---|
| 2,133,411 | 10/1938 | Zohe | 128/252 |
| 2,569,975 | 10/1951 | Cone | 169/31 |
| 2,804,257 | 8/1957 | Hasler et al. | 229/62.5 |
| 2,859,899 | 11/1958 | Kramer et al. | 222/95 |
| 2,891,700 | 6/1959 | Maynard | 222/92 |
| 2,920,798 | 1/1960 | Samuel | 222/394 |
| 3,081,911 | 3/1963 | Scholle | 222/107 |
| 3,083,875 | 4/1963 | Welty et al. | 222/95 |
| 3,090,526 | 5/1963 | Hamilton et al. | 222/105 |
| 3,171,571 | 3/1965 | Daniels | 222/94 |
| 3,197,073 | 7/1965 | Gondra | 222/107 |
| 3,240,399 | 3/1966 | Frandeen | 222/95 |
| 3,257,036 | 6/1966 | Micallef | 222/95 |
| 3,260,412 | 7/1966 | Larkin | 222/95 |
| 3,342,377 | 9/1967 | Perdey | 222/94 |
| 3,361,303 | 1/1968 | Jacuzzi | 222/183 |
| 3,420,413 | 1/1969 | Corsette | 222/107 |
| 3,549,050 | 12/1970 | Bruce et al. | 222/95 |
| 3,695,314 | 10/1972 | Watts et al. . | |
| 3,718,236 | 2/1973 | Reyner et al. | 222/386.5 |
| 3,838,794 | 10/1974 | Cogley et al. | 222/95 |
| 3,981,415 | 9/1976 | Fowler et al. | 222/95 |
| 4,014,461 | 3/1977 | Harvill | 222/94 |
| 4,062,475 | 12/1977 | Harris et al. | 222/95 |
| 4,087,026 | 5/1978 | Petterson | 222/386.5 |
| 4,137,930 | 2/1979 | Scholle | 137/68 |
| 4,138,036 | 2/1979 | Bond | 222/105 |
| 4,148,416 | 4/1979 | Gunn-Smith | 222/94 |
| 4,159,790 | 7/1979 | Bailey | 222/211 |
| 4,193,518 | 3/1980 | Holmes | 222/105 |
| 4,257,535 | 3/1981 | Mellett | 222/92 |
| 4,265,373 | 5/1981 | Stoody | 222/94 |
| 4,266,692 | 5/1981 | Clark | 222/94 |
| 4,270,533 | 6/1981 | Andreas | 128/214 |
| 4,284,671 | 8/1981 | Cancio et al. | 428/35 |
| 4,286,636 | 9/1981 | Credle | 141/114 |
| 4,322,020 | 3/1982 | Stone | 222/95 |
| 4,362,255 | 12/1982 | Bond | 222/107 |
| 4,381,846 | 5/1983 | Heck | 222/105 |

(List continued on next page.)

FOREIGN PATENT DOCUMENTS

| | | |
|---|---|---|
| 600684 | 6/1960 | Canada . |
| 732761 | 6/1955 | United Kingdom . |
| 756093 | 8/1956 | United Kingdom . |
| 1473524 | 5/1977 | United Kingdom . |
| WO 83/01605 | 5/1983 | WIPO . |
| WO 85/04383 | 10/1985 | WIPO . |
| WO 86/00868 | 2/1986 | WIPO . |

*Primary Examiner*—Ed Tolan
*Attorney, Agent, or Firm*—Jones & Askew, LLP

[57] ABSTRACT

An apparatus for inserting a dip strip within a flexible pouch. The apparatus has a first advance means for advancing a predetermined length of the dip strip material and a punch means for punching a hole in the material. The apparatus has a second advance means for advancing the strips of the flexible pouch material and an insertion means for inserting the dip strip material between the strips of the flexible material. The apparatus also includes a side sealing means for sealing a plurality of lateral lines along the strips of the flexible material and a cross sealing means for sealing the dip strip material between the strips of the flexible material in the vicinity of the dip strip hole such that a transverse seal line is created and the flexible pouch is formed.

19 Claims, 7 Drawing Sheets

U.S. PATENT DOCUMENTS

| | | | |
|---|---|---|---|
| 4,445,550 | 5/1984 | Davis et al. | 141/329 |
| 4,513,884 | 4/1985 | Magid | 222/94 |
| 4,524,458 | 6/1985 | Pongrass et al. | 383/33 |
| 4,601,410 | 7/1986 | Bond | 222/92 |
| 4,893,731 | 1/1990 | Richter | 222/92 |
| 4,998,990 | 3/1991 | Richter et al. | 222/92 |
| 5,647,511 | 7/1997 | Bond | 222/105 |
| 5,743,435 | 4/1998 | Tomic | 222/105 |
| 5,749,493 | 5/1998 | Boone et al. | 222/105 |
| 5,776,044 | 7/1998 | Clark | 493/346 |
| 5,868,658 | 2/1999 | Wild | 493/212 |

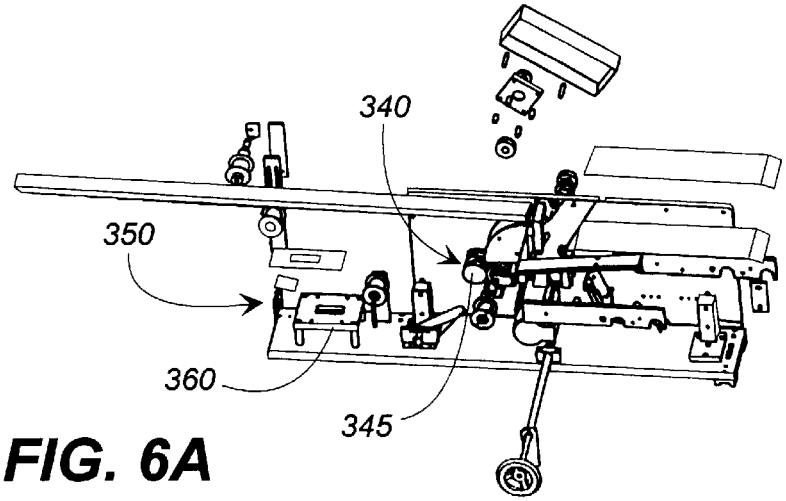
FIG. 6A
FIG. 6B
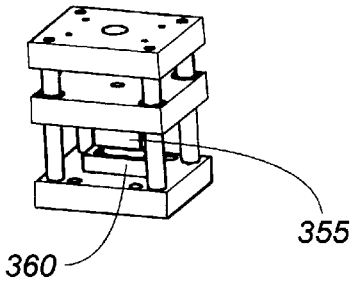
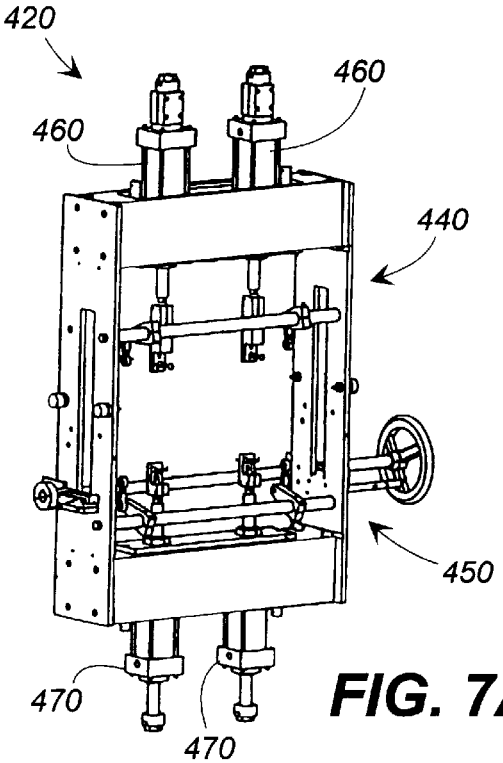
FIG. 7A
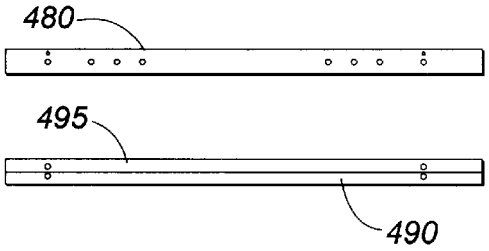
FIG. 7B

METHOD AND APPARATUS FOR MANUFACTURING A FLUID POUCH

TECHNICAL FIELD

The present invention relates to a method and apparatus for manufacturing a fluid pouch and more particularly relates to a method and apparatus for manufacturing a fluid pouch with a dip strip positioned and sealed therein.

BACKGROUND OF THE INVENTION

Various types of plastic pouches have been used to contain, transport, and dispense fluids such as soft drink syrup, milk, and water. These plastic pouches are relatively inexpensive to make and use and have adequate burst strength. A specific example includes a plastic pouch used as a "bag in box." Such a "bag in box" is commonly used in the soft drink industry to deliver soft drink syrup to a customer. The customer accesses the syrup in the "bag in box" through a spout in the bag. The box provides structural support for the bag while the bag is emptied. A plastic dip strip or dip tube is often included within the bag to aid in the withdrawal of the syrup. The strip prevents the bag from collapsing while the syrup is being withdrawn.

An example of a known bag with a dip strip therein is shown in U.S. Pat. No. 5,647,511. This reference describes a plastic bag with a spout on one end. A plastic evacuation insert has a mounting ring and a multi-channel form extending radially from the ring. The form does not extend the entire length of the bag.

Although this type of design assists in the withdrawal of fluid from the bag, the design has several drawbacks. First, because the form is not anchored at both ends, the form on occasion can puncture the lower end of the bag. Second, because the spout and the form are directly connected, the fluid fill time of the bag is somewhat slow. There is insufficient clearance between the spout and the form to allow a high volume of fluid to be poured into the bag in a given amount of time. The form and the spout create a bottleneck effect limiting the fill time of the bag.

What is needed therefore, is a method and apparatus for manufacturing a fluid pouch with a dip strip therein that is both fast and safe for the customer to use. The pouch preferably will be difficult to puncture and will permit high-speed filling operations.

SUMMARY OF THE INVENTION

The present invention provides an apparatus for inserting a dip strip within a flexible pouch. The dip strip is formed from a continuous strip of dip strip material. The flexible pouch is formed from a first and a second continuous strip of a flexible material. The apparatus has a first advance means for advancing a predetermined length of the dip strip material and a punch means for punching a hole in the material. The apparatus has a second advance means for advancing the strips of the flexible material and an insertion means for inserting the dip strip material between the strips of the flexible material. The apparatus also includes a side sealing means for sealing a plurality of lateral lines along the strips of the flexible material and a cross sealing means for sealing the dip strip material between the strips of the flexible material in the vicinity of the dip strip hole such that a transverse seal line is created and the flexible pouch is formed.

Specific embodiments may include the use of a dip strip with one or more flat sides and a plurality of ribs. The punch means may be a punch for removing a portion of the plurality of the ribs. The cross sealing means may be a press for sealing the flat sides of the dip strip material within the transverse seal line after the ribbed portion has been removed.

The first advance means includes a spool upon which the dip strip material is loaded. A dancer system is used for pulling the dip strip material from the spool. A servo apparatus then advances the dip strip material from the dancer system to the punch means. The punch means includes a punch and a die. The second advance means includes a plurality of servos. The insertion means includes a plurality of rollers. The side seal means includes a plurality of sealing units. The sealing units each have a plurality of air cylinders and a heated sealing bar. The cross seal means includes a plurality of air cylinders and a plurality of heated sealing bars. The heated sealing bars have a plurality of heating zones.

A plurality of the drive means may be disposed along several predetermined paths for advancing the continuous strips of pouch material and dip strip material. A plurality of rollers also are disposed along the predetermined paths for positioning the dip strip material between the continuous strips of pouch material. The drive means advances the continuous strips of material at a predetermined rate. Likewise, the dip strip punch means, the side seal means, and the cross seal means are all activated at a predetermined interval. The operation of the apparatus is governed by a controller.

The apparatus further includes a hole punch means for punching a spout receiving hole in the strips of the flexible material and a spout insertion means for inserting a spout in the hole. A strip cleaning means is used for removing particles from the strips of flexible material. A segment sealing means reinforces the cross seal in said vicinity of the hole by pressing the flat bases of the dip strip between the continuous strips of the flexible material. A clamp cooling means is used for cooling the cross seal. A serration means is used for separating the pouch from the continuous strips of the flexible material. A loading means is used for loading the pouch for transport.

The method of the present invention is for manufacturing a sealed pouch with a dip strip positioned therein. The method includes the steps of advancing a first one of the plurality of continuous strips of pouch material along a first predetermined path, advancing a second one of the plurality of continuous strips of pouch material along a second predetermined path, advancing the continuous strip of dip strip material along a third predetermined path, removing a portion of the ribs in the continuous strip of dip strip material such that only the flat portions remain, positioning along a fourth predetermined path the continuous strips of pouch material with the continuous strip of dip strip material positioned between the pouch material strips, creating a side seal along a plurality of lateral lines along the continuous strips of pouch material, and creating a cross seal along a path perpendicular to the fourth predetermined path such that the cross seal includes the flat portions of the continuous strip of dip strip material.

It is thus an object of the present invention to provide an improved pouch assembly method and apparatus.

It is another object of the present invention to provide a method and apparatus for the assembly of a flexible pouch with a dip strip sealed therein.

It is a further object of the present invention to provide a method and apparatus for sealing dip strip material between the walls of a flexible pouch.

It is a still further object of the present invention to provide a method and apparatus for the high speed manufacture of a flexible pouch with a dip strip sealed therein.

It is a still further object of the present invention to provide a method and apparatus for the manufacture of a flexible pouch with a flexible dip strip sealed therein for improved resistance to puncture.

It is a still further object of the present invention to provide a method and apparatus for the manufacture of a flexible pouch with a flexible dip strip sealed therein for increased fluid filing capacity.

Other objects, features, and advantages of the present invention will become apparent upon review of the following description of the preferred embodiments of the present invention, when taken in conjunction with the drawings and the appended claims.

BRIEF DESCRIPTION OF THE DRAWINGS

FIGS. 6A–B are perspective views of the servo apparatus of the dip strip feed assemblies and the punch assembly of the punch station.

FIGS. 7A–B are perspective views of the side sealing apparatus and the sealing bars.

DETAILED DESCRIPTION OF THE INVENTION

Figure 1:
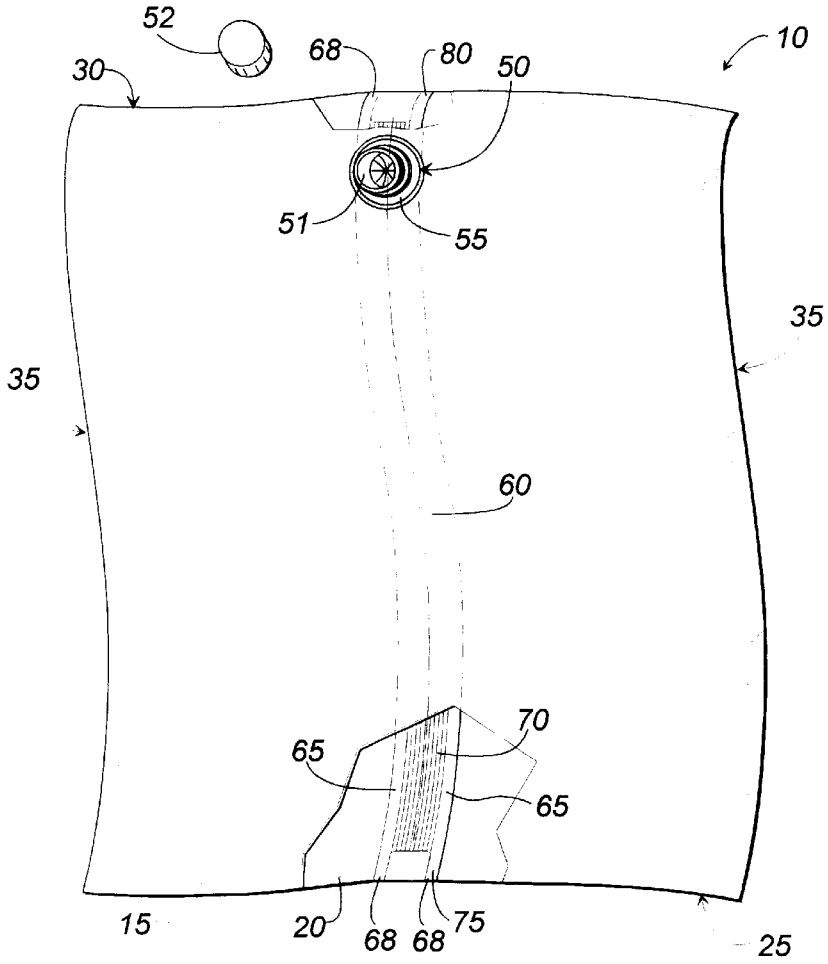
FIG. 1 is a partial cut away view of the pouch showing the dip strip.

Referring now in more detail to the drawings in which like numerals refer to like parts throughout the several views, FIG. 1 shows a pouch 10 as manufactured by the present invention. As described in commonly-owned U.S. Pat. No. 5,915,596, the pouch 10 includes a pair of flexible walls 15, 20 sealed together at a first end 25, a second end 30, and along the lateral sides 35 by heat sealing. U.S. Pat. No. 5,915,596 is incorporated herein by reference. As described in more detail below, the first end 25 of one pouch 10 and the second end 30 of another pouch 10 are commonly sealed along a cross seal 28. Each wall 15, 20 preferably comprises two (2) plys, an inner ply 40 and an outer ply 45. The inside ply 40 may be a web of two (2) mil linear low density polyethylene ("LLDPE") or similar materials. The outer ply 45 may be a four (4) mil coextrusion layer of LLDPE/nylon/LLDPE, with tie layers on each side of the nylon, or similar materials. The two (2) LLDPE layers are preferably about 1.4 mil, the nylon about 1.0 mil, and the tie layers about 0.1 mil.

The pouch 10 has a spout 50 positioned near the second end 30 of the pouch 10. The spout 50 has an internal valve 51 and a cap 52. The spout 50 also has a flange 55 that is heat sealed to the upper pouch wall 15. The pouch 10 further includes a flat dip strip 60 that is aligned underneath the spout 50 and the upper wall 15. The dip strip 60 provides for fluid communication between the spout 50 and the far reaches of the pouch 10. The dip strip 60 is preferably a flexible plastic material such as an extruded polyethylene or similar materials. The dip strip includes a flat base 65, a plurality of ribs 70 running along substantially the entire length of the dip strip 60 along the flat base 65, a first end 75, and a second end 80. The first and second ends 75, 80 are substantially U-shaped, in that the ribs 70 and that portion of the flat base 65 underneath the ribs 70 have been removed such that only the flat base 65 remains, i.e., only one or more flanges 68 of the flat base 65 material remain. This portion of the ribs 70 that is removed from the dip strip 60 is called a slug 72. The first and the second ends 75, 80 of the dip strip 60 are heat sealed into place between the two walls 15, 20 at the first end 25 and the second end 30 of the pouch 10 along the cross seal 28.

Figure 2:
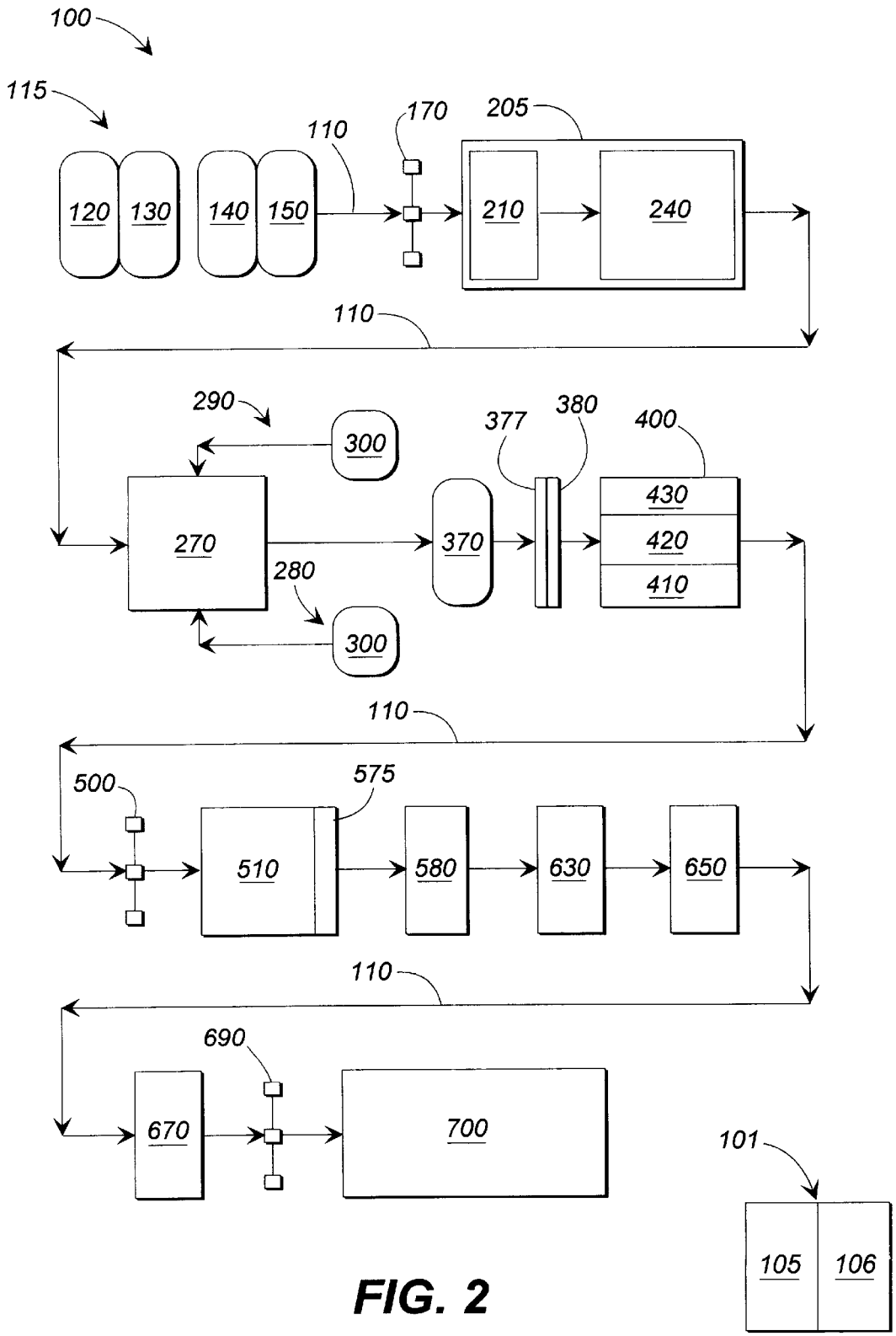
FIG. 2 is a schematic view showing the steps involved in the manufacturing of a pouch according to the present invention.
Figure 3A:
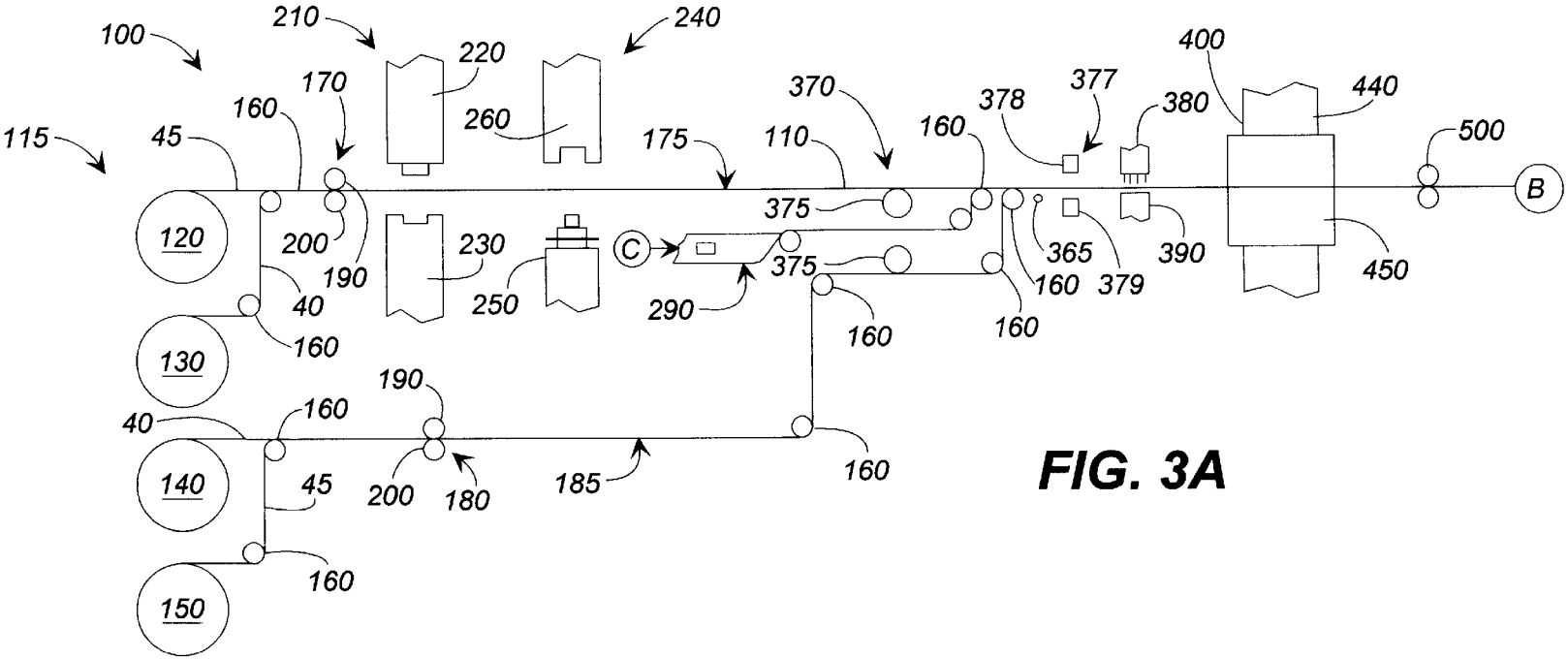
FIGS. 3A–C are schematic sectional views showing the major elements of the present invention in the manufacture of the pouch.
Figure 3B:
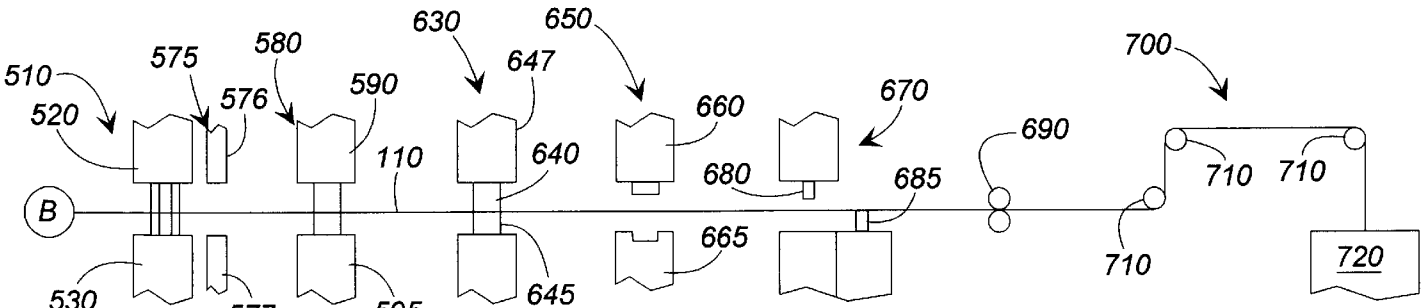

FIGS. 2–3 show schematic views of an apparatus 100 for making the pouch 10. The apparatus 100 is operated by one or more control systems 101. The control systems 101 include a controller 105. The controller 105 is a standard microprocessor-based Programmable Logic Controller ("PLC"). The controller 105 enables the user to set the variables of the apparatus 100 such as the temperature and dwell time of the presses described below. The controller 105 includes a standard screen, disc drive, key board, and memory (not shown). The control systems 101 may also include a data monitor 106. The data monitor 106 is a standard Personal Computer with a data acquisition card (not shown). The data monitor 106 monitors and records the temperature, force, and dwell time of the presses described below. If any of these variables exceed their predetermined range of values, the data monitor 106 will shut the apparatus 100 down and report the anomaly.

Figure 4:
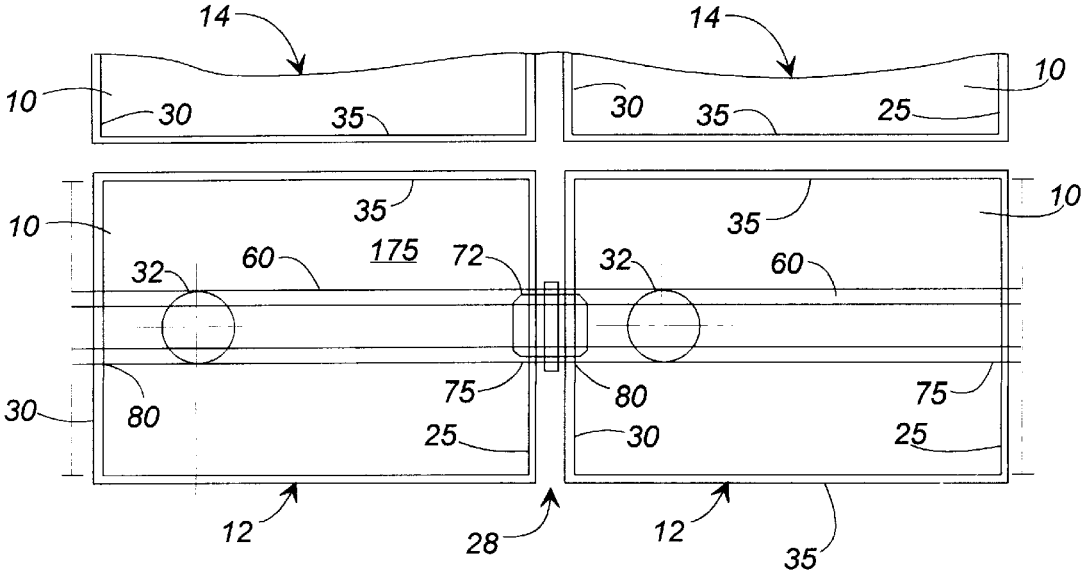
FIG. 4 is a plan view showing the upper web.

The apparatus 100 operates in assembly line fashion along a predetermined path 110. The apparatus 100 includes a plurality of material rolls 115. The material rolls 115 include an upper outer-ply roll 120 loaded with the outer ply 45, an upper inner ply roll 130 loaded with the inner ply 40, a lower inner ply roller 140 loaded with the inner ply 40, and a lower outer ply roller 150 loaded with the outer ply 45. The material rolls 115 are spool-shaped rollers or other conventional forms. The outer ply 45 and the inner ply 40 are pulled off of the upper rolls 120, 130 along a plurality of rollers 160 by an upper feed servo 170. The outer ply 45 is fed directly on top of the inner ply 40 to form an upper wall web 175. Likewise, the outer ply 45 and the inner ply 40 are pulled off of the lower rolls 140, 150 along the rollers 160 by a lower feed servo 180. The outer ply 45 is fed directly beneath the inner ply 40 to form a lower wall web 185. Each of the rolls 115 preferably has sufficient web material 175, 185 in the transverse direction, i.e., in the direction perpendicular to the predetermined path 110, to form two (2) pouches 10 at one (1) time. FIG. 4 shows an upper web 175 with a left pouch 12 and a right pouch 14. This embodiment of the apparatus 100 is described as "two (2) up", in that it makes the two (2) pouches 10 at a time.

The feed servos 170, 180 are conventional roller-type servos that squeeze the webs 175, 185 between a plurality of upper servo wheels 190 and a plurality of lower servo wheels 200. The wheels 190, 200 are made from rubber or similar elastic-type materials. The webs 175, 185 are advanced along the predetermined path 110 by the servos wheels 190, 200 under tension. The servo wheels 190, 200 also spread or smooth the webs 175, 185 so as to eliminate or reduce any wrinkles therein. The speed of the servo wheels 190, 200, and hence the rate of advance of the webs 175, 180, is governed by the controller 105. The advance of the webs 175, 180 is generally intermittent to permit each station shown in FIGS. 2 and 3 to perform its designated task.

After advancing through the upper feed servos 170, the upper web 175 passes through a hole punch and spout insert assembly 205 positioned along the predetermined path 110. The hole punch and spout insert assembly 205 includes a hole punch assembly 210 and a spout insert assembly 240. The hole punch assembly 210 and the spout insert assembly 240 may be combined within one (1) assembly 205, as is shown here, or the two (2) systems 210, 240 may be independent systems positioned separately along the predetermined path 110.

The hole punch assembly 210 has a fixed upper punch 220 positioned above the upper wall 15 and a vertically movable pneumatic die 230 positioned below the upper wall 15 (or vice versa). The hole punch 210 punches a spout receiving hole 32 through the upper web 175. The operation of the die 230 is governed by the controller 105 such that a spout receiving hole 32 is punched at predetermined intervals, i.e., one (1) hole 32 for the length of each pouch 10. Because two (2) pouches 10 are created at a time, the hole punch assembly 210 has two (2) punches 220 and dies 230 positioned next to each other in a direction perpendicular to the predetermined path 110.

The upper web 175 then continues to the spout insert assembly 240 positioned along the predetermined path 110. The spout insert assembly 240 includes both a pneumatic cylinder and piston unit 250 that supports a spout 50 and moves it into the spout receiving hole 32 and also an upper fixed heating element 260 (or vice versa) that heat seals the spout 50 to the upper wall 15. The fixed heating element 260 is controlled by conventional thermocouples (not shown). The spout insert assembly 240 includes two (2) sets of the cylinder and piston units 250 and heating elements 260 positioned next to each other in a direction perpendicular to the predetermined path 110. The spout 50 may be preassembled with the cap 52 or a separate capping station (not shown) may be employed. The timing of the insertion of the spout 50 into the hole 32, along with the heat and the dwell time of the spout insert assembly 240 are all controlled by the controller 105, while these variable and the force to be applied are monitored and recorded by the data monitor 106.

Figure 5:
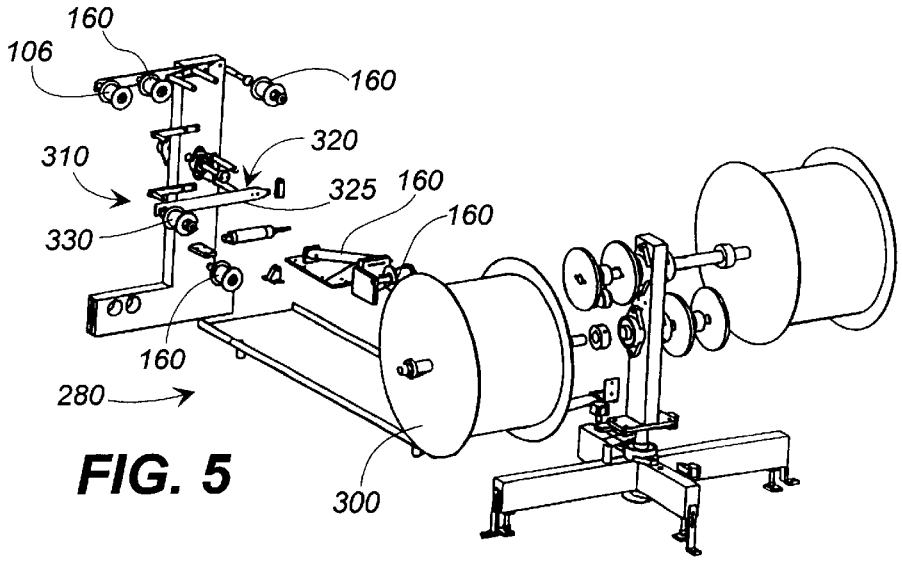
FIG. 5 is a perspective view of the spool and dancer system of the dip strip material feed assemblies.

The next station on the predetermined path 110 is the dip strip punch station 270. The upper and lower webs 175, 185 pass over and under the dip strip punch station 270 respectively. As is shown in FIGS. 5 and 6, the dip strip punch station 270 includes two (2) identical feed assemblies, a left feed assembly 280 for the left side pouch 12 and a right feed assembly 285 for the right side pouch 14. Because the feed assemblies 280, 285 are identical, only the left feed assembly 280 will be described.

Figure 3C:
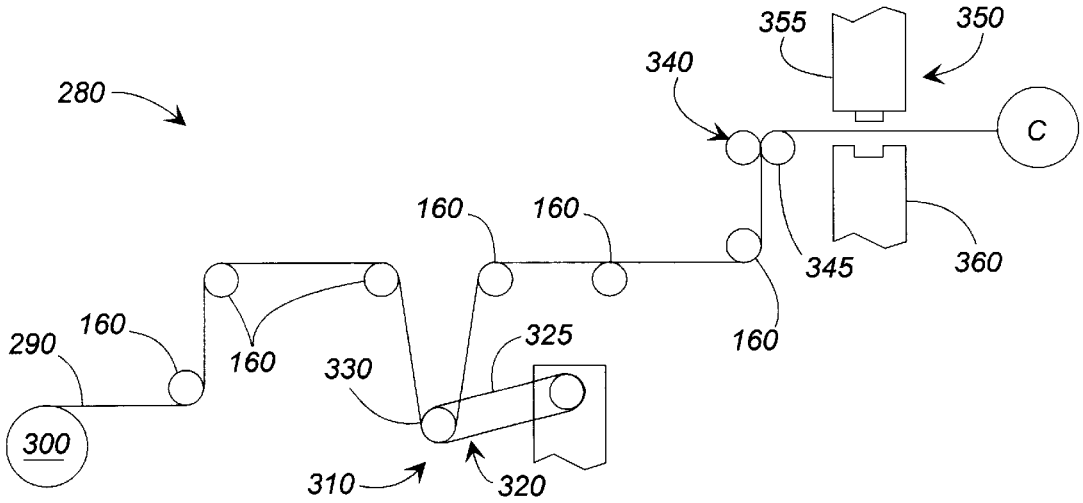

As is described in FIGS. 3C and 4, the left feed assembly 280 includes a spool 300 with a continuous strip of dip strip material 290 thereon. The dip strip material 290 is unwound from the spool 300 by a dancer system 310. The dancer system 310 includes a dancer arm 320 that draws the dip strip material 290 from the spool 300. The dancer arm 320 is an air-cylinder operated lever arm 325 with a roller 330 at one end. The dip strip material 290 is unwound from the spool 300 and pulled through a series of rollers 160 by the dancer arm 320. The dip strip material 290 is then pulled into a servo-driven roller apparatus 340. The servo apparatus 340 has a pair of rollers 345 that pulls the material 290 from the dancer arm 320. The rollers 345 are gear driven to prevent slippage. After the servo apparatus 340 pulls a sufficient length of the dip strip material 290 from the dancer arm 320, the servo 340 locks the material 290 in place such that the dancer arm 320 can pull more material 290 off of the spool 300. The amount of dip strip material 290 drawn by the dancer arm 320 in the next advance is determined by the amount of material 290 pulled in by the servo apparatus 340.

The dip strip material 290 is then pulled towards a punch station 350. The punch station 350 has a vertically moveable pneumatic punch 355 and a fixed die 360 (or vice versa). The punch station 350 punches out the slugs 72 in the ends 75, 80 of two adjoined dip strips 60. The slugs 72 that are punched out of the material 290 are removed from the apparatus 100 via a conveyor (not shown). The speed and timing of the dancer arm 320, the servo 340, and the punch 350 are governed and coordinated by the controller 105. The dancer arm 320 and the servo 340 preferably match the velocity, acceleration, and draw length of the feed servos 170, 180.

To ensure that the ends 75, 80 of the dip strip material 290, i.e., the area where the slugs 72 have been removed, are properly aligned between the webs 175, 185 with respect to the location of the cross seal 28, two or more sensors 365 are positioned along the predetermined path 110. The sensors 365 are conventional photoelectric-eyes or other types of conventional electrical or mechanical sensors. By determining whether the sensors 365 are both covered or both uncovered, the controller 105 ensures that the ends 75, 80 of the dip strip material 290 are aligned with the first and second ends 25, 30 of the pouch 10 such that the cross seal 28 is properly applied as explained below.

While the dip strip material 290 is being punched, the upper web 175 and the lower web 185 pass through a film cleaner device 370 positioned on the predetermined path 110. The film cleaner 370 may have one or more rubber rollers 375 with an adhesive film thereon that picks up any particles that may be on the inner side of the webs 175, 185. The film cleaner 370 largely acts like a lint brush. A film cleaner 370 for the outer side of the webs 175, 185 also may be employed, preferably located adjacent to the material rolls 115.

The dip strip material 290 is then maneuvered into the predetermined path 110 directly underneath the upper web 175 via the rollers 160. Likewise, the lower web 185 is maneuvered into the predetermined path 110 directly underneath the dip strip material 290 via the rollers 160. The joined webs 175, 185 and dip strip material 290 are then passed through a static inducer 377. The static inducer includes an electrified upper bar 378 and a grounded lower bar 379. The static inducer generates an electric field of approximately 30,000 KV to eliminate almost entirely any trapped air between the webs 175, 185 and the plys 40, 45. The webs 175, 185 then advance between a brush 380 and a web support 390. The brush 380 ensures that a random spout 50 or cap 52 does not advance along the upper web 175. Additional web supports 390 may be employed along the predetermined path 110.

The webs 175, 185 then travel together along the predetermined path 110 through a side sealer apparatus 400. The side sealer apparatus 400 includes three (3) identical pneumatic sealing units, left sealing unit 410, center sealing unit 420, and right sealing unit 430. The sealing units 410, 420, 430 seal the upper and lower webs 175, 185 together along a plurality of lateral lines. These lines include the left and right lateral edges 35 and along the middle, i.e., in the direction of the predetermined path 110, of the webs 175, 185 to form the two (2) pouches 10.

As is shown in FIG. 7, each sealing unit 410, 420, 430 has an upper die unit 440 and a lower die unit 450. Each die unit 440, 450 is operated by a pair of upper air cylinders 460 and a pair of lower air cylinders 470. The upper air cylinders 460 are attached to an upper sealing bar 480. The lower air cylinders 470 are attached to a lower sealing bar 490. The upper and lower bars 480, 490 are heated by conventional heating elements (not shown) and controlled by conventional thermocouples (not shown). The lower bar 490 is generally covered with a rubber padding 495. The timing of each die unit 440, 450, along with the temperature and the dwell time with which the bars 480, 490 operate is controlled by the controller 105. Likewise, the temperature, dwell time, and force of the bars 480, 490 are monitored and recorded by the data monitor 106. The heat and force of the side sealer 400 must be sufficient to melt the web material 175, 185 to form an adequate water-tight side seal.

The webs 175, 185 are then advanced along the predetermined path 110 by a middle servo unit 500. The middle servo unit 500 is similar to the feed servos 170, 180 described above and is controlled by the controller 105 in the same fashion. The wheels 190, 200 of the middle servo unit 500 also aid in the removal of any trapped air from between the webs 175, 185 and the plys 40, 45.

Figure 8A:
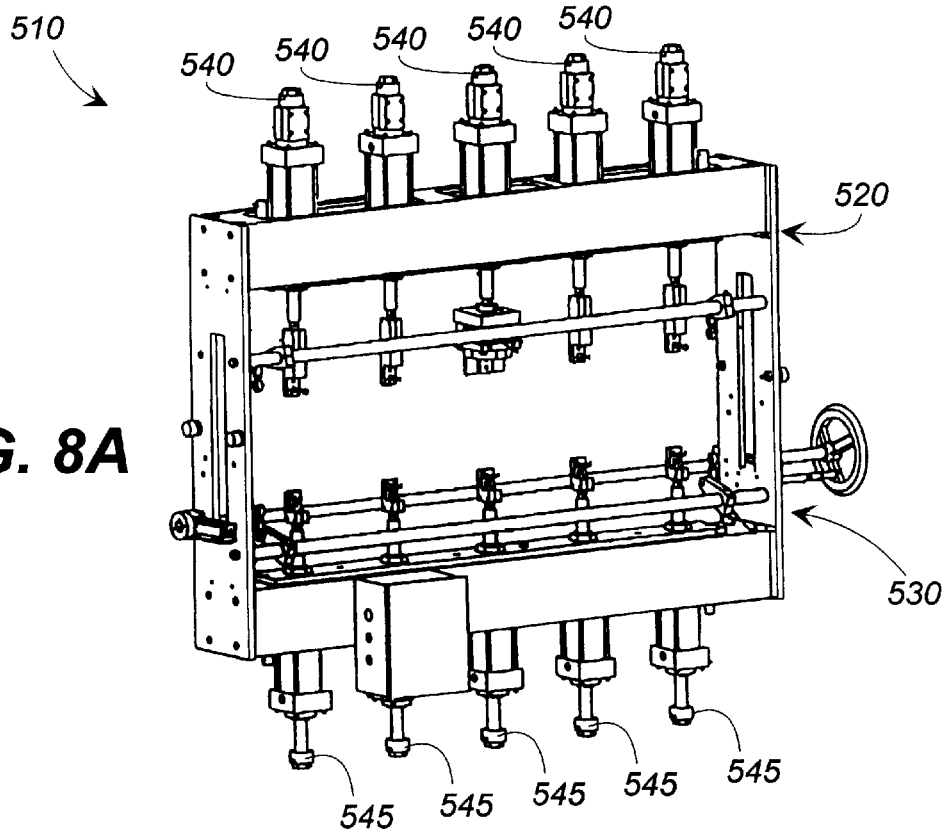
FIGS. 8A–B are perspective views of the cross sealing apparatus and the sealing bars.
Figure 8B:
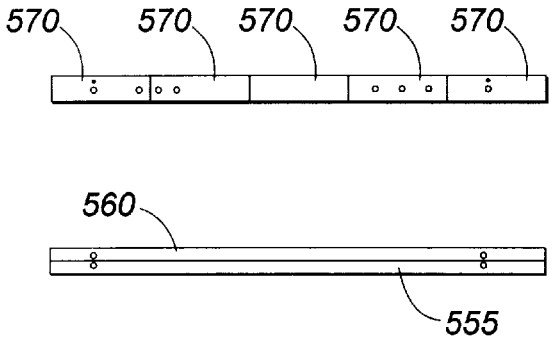

The webs 175, 185, now sealed along their lateral sides 35 and along the middle, move into a pneumatic cross sealer apparatus 510. As is shown in FIG. 8, the cross sealer apparatus 510 has an upper die unit 520 and a lower die unit 530. Each die unit 520, 530 is operated by a plurality of upper air cylinders 540 and lower air cylinders 545. Five (5) air cylinders 540 are shown in FIG. 8 for each die unit 520, 530. The upper air cylinders 540 are attached to an upper sealing bar 550. The lower air cylinders 545 are attached to a lower sealing bar 555. The upper and lower bars 550, 555 are heated by conventional heating elements (not shown) and controlled by conventional thermocouples (not shown). The lower bar 555 is generally covered with a rubber padding 560. The timing of each die unit 520, 530 is controlled by the controller 105.

Each air cylinder 540, 545 also indicates a heating zone 570 on the sealing bars 550, 555. In the typical operation of the cross sealer 510, the heat generated along the sealing bars 550, 555 moves laterally towards the ends of the bars 550, 555, i.e., towards the lateral edges of the webs 175, 185. As a result, the quality of the seal across the webs 175, 185 may not be consistent. The controller 105, however, can control the heat in each zone 570 individually to ensure consistent heating and sealing. The temperature and the dwell time with which the bars 550, 555 operate are controlled by the controller 105, while these variables and the force applied are monitored and recorded by the data monitor 106.

The pneumatic cross sealer apparatus 510 also may include a clamp apparatus 575. The clamp apparatus 575 includes a movable upper clamp bar 576 and fixed lower bar 577 (or vice versa). The clamp apparatus 575 clamps down on the dip strip 60 between the webs 175, 185 to relieve any tension on the dip strip 60 while the cross sealer 510 operates. By relieving the tension in the dip strip 60, the clamp apparatus 575 reduces the possibility of tearing the dip strip 60.

The cross sealer 510 seals the webs 175, 185 in the direction perpendicular to the direction of travel along the predetermined path 110 along the cross seal 28. The first end 75 of the dip strip 60 from the continuous strip of dip strip material 290 is sealed at the first end 25 of the pouch 10 and the second end 80 of the dip strip 60 from the continuous strip of dip strip material 290 is sealed at the second end 30 of the pouch 10. As described above, the slug portion 72 of the first and second ends 75, 80 of the dip strip 60 has been removed such that only the flanges 68 of the flat base 65 are within the cross seal 28. The heat and force of the cross sealer 510 must be sufficient to melt the web material 175, 185 and the dip strip material 290 to form an adequate cross seal 28. The ribs 70 are removed to ensure that no excess plastic is within the cross seal 28 that might prevent a water tight seal or that might extend the cooling time of the cross seal 28. Further, removal of the ribs 70 ensures that there are no sharp edges in the cross seal 28 that may puncture the pouch 10.

Figure 9A:
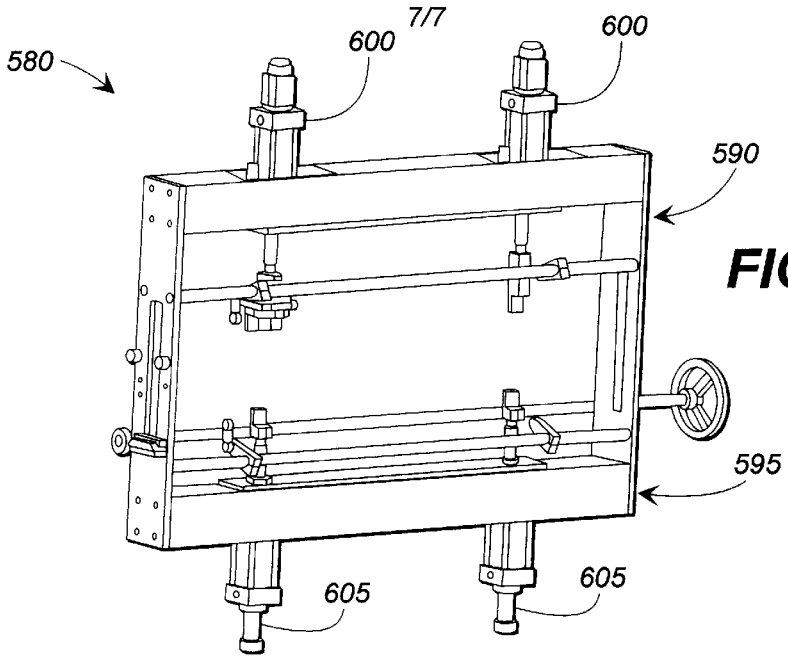
FIGS. 9A–C are perspective views of the segment sealing apparatus, the bottom sealing bar, and the top sealing bar with die.
Figure 9B:
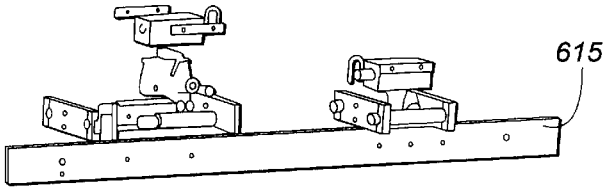
Figure 9C:
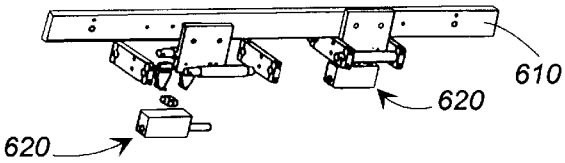

The webs 175, 185 then advance along the predetermined path 110 through a pneumatic segment sealer apparatus 580. As is shown in FIGS. 9, the segment sealer 580 has an upper die unit 590 and a lower die unit 595. The die units 590, 595 are operated by a pair of upper air cylinders 600 and a pair of lower air cylinders 605. Two (2) air cylinders 600, 605 are shown for each die unit 590, 595. The upper air cylinders 600 are attached to an upper sealing bar 610 and the lower air cylinders 605 are attached to a lower sealing bar 615. The upper and lower bars 610, 615 are heated by conventional heating elements (not shown) and controlled by conventional thermocouples (not shown). The upper bar 610 has two rubber coated die units 620 attached thereto. The die units 620 are sized to concentrate the temperature and force directly on the dip strip material 290 in the area of the cross seal 28. The temperature and the dwell time with which the bars 610, 615 operate are controlled by the controller 105, while these variables and the force applied are monitored and recorded by the data monitor 106. The segment sealer 580 is designed to further heat and press the cross seal 28 in the vicinity of the dip strip material 290 to ensure that the plastic dip strip material 290 is melted and flattened for a sufficient seal.

The webs 175, 185 then pass along the predetermined path 110 through a clamp cooling station 630. The clamp cooling station 630 has an upper clamp bar 640 and a lower clamp bar 645. At least one of the clamp bars 640, 645 is water cooled by conventional means. The clamp bars 640, 645 are applied to the webs 175, 185 by at least one (1) pneumatic cylinder 647 in the vicinity of the cross seal 28. The clamp bars 640, 645 reduce the temperature of the material in the cross seal 28. The reduction in temperature generally provides a stronger seal and permits the seal to be quickly cut as described below. The timing and operation of the clamp cooling station 630 is controlled by the controller 105.

Figure 10:
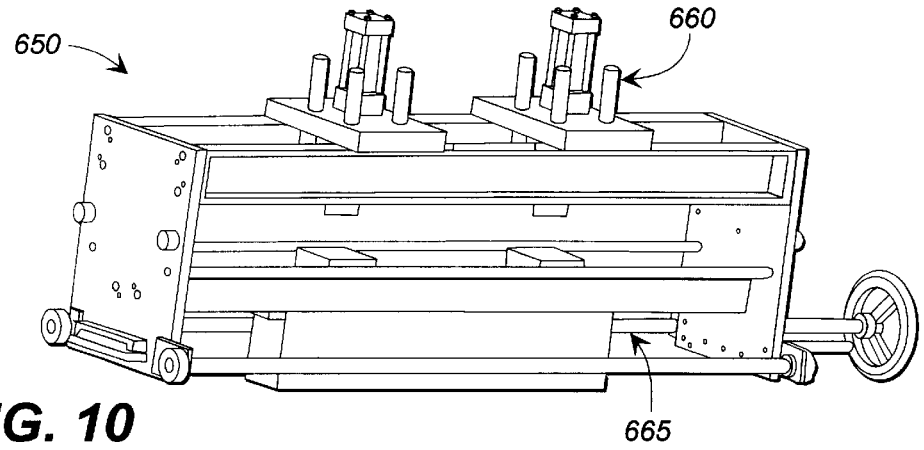
FIG. 10 is a perspective view of the cross seal punch station.

The webs 175, 185 then pass along the predetermined path 110 through a punch station 650. The punch station 650 has a conventional vertically moveable pneumatic upper punch 660 and a fixed lower die 665 (or vice versa). As is shown in FIG. 10, the punch station 650 may be used to remove any excess dip strip material 290 in the cross seal 28 area in preparation for cutting the webs 175, 185. The timing and operation of the punch station 650 is controlled by the controller 105.

The webs 175, 185 are then passed along the predetermined path 110 through a serration station 670. The serration station 670 includes a movable serration wheel 680 that travels in a perpendicular direction to the predetermined path 110 and perforates the webs 175, 185 between the respective cross seals 28. The timing and operation of the serration wheel 680 is controlled by the controller 105. A fixed serration wheel or knife 685 also may be positioned in the middle of the predetermined path 110 to separate the webs 175, 185 into the left and right pouches 12, 14. The serration devices 680, 685 leave the individual pouches 10 connected to each other by small tabs of material. The pouches 10 can be easily pulled apart later for individual use.

The webs 175, 185 then pass along the predetermined path through a loading servo 690. The loading servo 690 is similar to the feed servos 170, 180 and the middle servo 500. The timing and operation of the loading servo 690 is controlled by the controller 105. Finally, the webs 175, 185 pass along the predetermined path 110 into a stacking device 700. The stacking device 700 has a series of movable rollers 710 that stack the pouches 10 in a vertical fashion into a tote bin 720 or other conventional loading device for storage or transport.

In use, the webs 175, 185 are pulled off of the rolls 115 by the feed servos 170, 180 on to the predetermined path 110. The upper web 175 passes through the hole punch station 210 in which the spout receiving hole 32 is punched through the material. The upper web 175 then passes through the spout insert station 240 and the spout 50 is positioned in the hole 32 and heat sealed into place. As the spout 50 is being inserted into the upper web 175, the dip strip material 290 is removed from the spool 300 by the dancer system 310. The predetermined length of the dip strip material 290 is measured out by the servos 340 and advanced into the punch station 350. The ribbed section 70 of the dip strip material 290 is punched out in the first and second ends 75, 80 of the dip strip material 290.

The webs 175, 185 pass along the predetermined path 110 through the web cleaner 370 to remove any particles thereon. The webs 175, 185 and the dip strip material 290 are then aligned with the dip strip material 290 positioned between the webs 175, 185. The combined webs 175, 185 and the dip strip material 290 advance through the static inducer 377 to remove as much air as possible between the respective webs 175, 185 and the plys 40, 45. The webs 175, 185 then advance into the side sealer 400 in which the lateral edges 35 and the middle of the webs 175, 185 are heat sealed together.

The webs 175, 185 are then pulled through the middle servos 500 and into the cross sealer 510 in which the cross seal 28 is made. The cross seal 28 seals the first and the second ends 75, 80 of the dip strip 60 between the upper and lower webs 175, 185. The flanges 68 of the flat base 65 of the dip strip material 290 must be flattened by about fifty percent (50%) for a good seal 28. The webs 175, 185 are then advanced to the segment sealer 580 in which the cross seal 28 in the vicinity of the first and second ends 75, 80 of the dip strip material 290 is again pressed to ensure a proper seal. The cross seal 28 is then cooled in the clamp cooling station 630. If necessary, any excess dip strip material 290 in the vicinity of the cross seal 28 is removed by the punch 650. The pouches 10 are then separated via the serration station 670. The loading servo 690 then loads the pouches 10 into the stacking device 700 for transport to the customer.

The apparatus 100 is operated by the controller 105. The respective presses 240, 400, 510, 580 all have conventional load cells, heating elements, and thermocouples (not shown) to report the given load and temperature. The user can enter the appropriate temperatures and dwell time for the respective presses in the controller 105. For example, each heat zone 570 in the cross seal apparatus 510 has a heat "set" point or target temperature and a plus or minus range. Further, each press 240, 400, 510, 580 has an adjustable dwell time in terms of milliseconds. Finally, each press 240, 400, 510, 580 has a set point for monitoring the force to be applied as measured in Newtons in a plus or minus force range. The data monitor 106 will shut the apparatus 100 down if any of these variables are outside of the given ranges. The data monitor 106 will then report the nature of the problem.

By way of example, a typical setting for the temperatures, dwell times, and force for the apparatus 100 may include the following entries: moving in a direction perpendicular to the predetermined path 110, the heat zones 570 on the upper bar 550 of the cross seal apparatus 510 may be set at about 375 degrees (Fahrenheit), 408 degrees, 375 degrees, 408 degrees, and 375 degrees with a plus or minus range of about three (3) degrees. The lower bar 555 is set at about 275 degrees with a plus or minus range of about three (3) degrees. The lower bar 555 is generally set at a lower temperature than the upper bar 550. The force to be applied by both bars 550, 555 is about 100 Newtons with a plus or minus range of about twenty (20) Newtons. The dwell time is about 1000 milliseconds with a plus or minus monitoring range of about 300 milliseconds. Similar parameters can be entered and monitored for the remaining presses 240, 400, 580 on the apparatus 100. The temperature, force, and dwell time are each a function of the material used for the pouches 10.

Data for each seal on each pouch 10 is collected and stored by the controller 105. Each pouch 10 may be jet coated with an identification number and the date and time of manufacture to detect and trace the cause of any failures and to monitor quality control.

The apparatus 100 can produce approximately forty (40) pouches 10 per minute with an efficiency of approximately seventy percent (70%). The preferred individual components of the apparatus 100 are manufactured in part by GN Packaging Equipment of Mississauga, Ontario, Canada.

It should be understood that the foregoing relates only to the preferred embodiments of the present invention and that numerous changes may be made herein without departing from the spirit and scope of the invention as defined by the following claims.

We claim:

1. An apparatus for inserting a dip strip within a flexible pouch, said dip strip formed from a continuous strip of dip strip material and said flexible pouch formed from a first and a second continuous strip of flexible material, said apparatus comprising:

first advance means for advancing a predetermined length of said continuous strip of dip strip material;

punch means for punching a hole in said predetermined length of said continuous strip of dip strip material;

second advance means for advancing said first and second continuous strips of flexible material;

insertion means for inserting said continuous strip of dip strip material between said first and second continuous strips of flexible material;

side sealing means for sealing a plurality of lateral lines along said first and second continuous strips of said flexible material; and cross sealing means for sealing said continuous strip of dip strip material between said first and said second continuous strips of flexible material in a vicinity of said dip strip hole such that a transverse seal line is created and said flexible pouch is formed.

2. The apparatus for inserting a dip strip within a flexible pouch of claim 1, wherein said dip strip comprises one or more flat sides and a plurality of ribs and wherein said punch means for punching a hole in said predetermined length of said continuous strip of dip strip material comprises a punch for removing a portion of said plurality of said ribs.

3. The apparatus for inserting a dip strip within a flexible pouch of claim 2, wherein said cross sealing means forming said transverse seal line in said vicinity of said dip strip hole comprises a press for sealing said one or more flat sides of said continuous strip of dip strip material within said transverse seal line.

4. The apparatus for inserting a dip strip within a flexible pouch of claim 1, wherein said first advance means comprises a spool upon which said continuous strip of dip strip material is loaded.

5. The apparatus for inserting a dip strip within a flexible pouch of claim 4, wherein said first advance means comprises a dancer system for pulling said predetermined length of said continuous strip of dip strip material from said spool.

6. The apparatus for inserting a dip strip within a flexible pouch of claim 5, wherein said first advance means comprises a servo apparatus to advance said predetermined length of said continuous strip of dip strip material to said punch means.

7. The apparatus for inserting a dip strip within a flexible pouch of claim 1, wherein said punch means comprises a punch and a die.

8. The apparatus for inserting a dip strip within a flexible pouch of claim 1, wherein said second advance means comprises a plurality of servos.

9. The apparatus for inserting a dip strip within a flexible pouch of claim 1, wherein said insertion means comprises a plurality of rollers.

10. The apparatus for inserting a dip strip within a flexible pouch of claim 1, wherein said side seal means comprises a plurality of sealing units.

11. The apparatus for inserting a dip strip within a flexible pouch of claim 10, wherein said sealing units each comprise a plurality of air cylinders.

12. The apparatus for inserting a dip strip within a flexible pouch of claim 11, wherein said sealing units each comprise a heated sealing bar.

13. The apparatus for inserting a dip strip within a flexible pouch of claim 1, wherein said cross seal means comprises a plurality of air cylinders.

14. The apparatus for inserting a dip strip within a flexible pouch of claim 13, wherein said cross seal means comprises a plurality of heated sealing bars.

15. The apparatus for inserting a dip strip within a flexible pouch of claim 14, wherein said heated sealing bars comprise a plurality of heating zones.

16. The apparatus for inserting a dip strip within a flexible pouch of claim 1, further comprising cutting means for cutting said flexible pouch from said continuous strip of dip strip material and said first and said second continuous strip of flexible material along said transverse seal line.

17. A method for manufacturing a sealed pouch from a plurality of continuous strips of pouch material, said sealed pouch comprising a dip strip positioned therein, said dip strip comprising one or more flat portions and a plurality of ribs, and said dip strip formed from a continuous strip of a dip strip material, said method comprising the steps of:

advancing a first one of said plurality of continuous strips of pouch material along a first predetermined path;

advancing a second one of said plurality of continuous strips of pouch material along a second predetermined path;

advancing said continuous strip of dip strip material along a third predetermined path;

removing a portion of said plurality of ribs from said continuous strip of dip strip material such that said one or more flat portions of said continuous strip of dip strip material remain;

positioning along a fourth predetermined path said first one of said continuous strips of pouch material, said continuous strip of dip strip material, and said second one of said continuous strips of pouch material, with said continuous strip of dip strip material positioned between said first and said second continuous strips of pouch material;

creating a side seal along a plurality lateral lines along said first and said second continuous strips of pouch material; and creating a cross seal along a path perpendicular to said fourth predetermined path such that said cross seal includes said one or more flat portions of said continuous strip of dip strip material.

18. An apparatus for inserting a dip strip within a flexible pouch, said dip strip formed from a continuous strip of dip strip material, said continuous strip of dip strip material comprising a plurality of holes occurring along said continuous strip at a predetermined length, and said flexible pouch formed from a plurality of continuous strips of flexible material, said apparatus comprising:

first advance means for advancing a first and a second continuous strip of flexible material from said plurality of continuous strips at an interval about equal to said predetermined length;

second advance means for advancing said continuous strip of dip strip material between said first and second continuous strips of flexible material at said interval about equal to said predetermined length;

side sealing means for sealing a plurality of lateral lines along said first and second continuous strips of said flexible material at said predetermined length; and cross sealing means for sealing said continuous strip of dip strip material between said first and said second continuous strips of flexible material in a vicinity of one of said plurality of dip strip holes such that a transverse seal line is created.

19. The apparatus for inserting a dip strip within a flexible pouch of claim 18, wherein said dip strip material comprises a first flat side, a second flat side, and a plurality of ribs positioned between said first and said second flat sides and wherein said cross sealing means forming said transverse seal line in said vicinity of one of said dip strip holes comprises a press for sealing said first flat side and said second flat side of said continuous strip of dip strip material within said transverse seal line.

* * * * *